US007294229B2

(12) United States Patent
Hada et al.

(10) Patent No.: US 7,294,229 B2
(45) Date of Patent: Nov. 13, 2007

(54) TISSUE PRODUCTS HAVING SUBSTANTIALLY EQUAL MACHINE DIRECTION AND CROSS-MACHINE DIRECTION MECHANICAL PROPERTIES

(75) Inventors: Frank Stephen Hada, Appleton, WI (US); Andrew Peter Bakken, Appleton, WI (US); Michael Alan Hermans, Neenah, WI (US); Jeffrey David Mathews, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 315 days.

(21) Appl. No.: 10/876,085

(22) Filed: Jun. 22, 2004

(65) Prior Publication Data

US 2005/0136222 A1 Jun. 23, 2005

Related U.S. Application Data

(63) Continuation-in-part of application No. 10/745,184, filed on Dec. 23, 2003, now abandoned.

(51) Int. Cl.
*D21H 27/00* (2006.01)

(52) U.S. Cl. ..... 162/109; 162/117; 428/156

(58) Field of Classification Search ..... 162/109, 162/111–113, 117, 123–133; 428/152–153, 428/156, 15

See application file for complete search history.

(56) References Cited

U.S. PATENT DOCUMENTS

| | | | | |
|---|---|---|---|---|
| 3,879,257 | A | 4/1975 | Gentile et al. | |
| 4,191,609 | A | 3/1980 | Trokhan | |
| 4,759,391 | A | 7/1988 | Waldvogel et al. | |
| 4,849,054 | A | 7/1989 | Klowak | |
| 5,302,443 | A | 4/1994 | Manning et al. | |
| 5,429,686 | A | 7/1995 | Chiu et al. | |
| 5,593,545 | A | 1/1997 | Rugowski et al. | |
| 5,607,551 | A | 3/1997 | Farrington, Jr. et al. | |
| 5,672,248 | A | 9/1997 | Wendt et al. | |
| 5,746,887 | A | 5/1998 | Wendt et al. | |
| 6,017,417 | A | 1/2000 | Wendt et al. | |
| 6,033,523 | A * | 3/2000 | Dwiggins et al. | 162/111 |
| 6,165,319 | A * | 12/2000 | Heath et al. | 162/112 |
| 6,368,454 | B1 | 4/2002 | Dwiggins et al. | |
| 6,423,180 | B1 | 7/2002 | Behnke et al. | |
| 6,558,511 | B2 | 5/2003 | Dwiggins et al. | |
| 6,592,714 | B2 | 7/2003 | Lamb | |
| 6,673,202 | B2 | 1/2004 | Burazin et al. | |
| 6,706,152 | B2 | 3/2004 | Burazin et al. | |
| 2002/0104630 | A1* | 8/2002 | Dwiggins et al. | 162/123 |
| 2003/0084953 | A1* | 5/2003 | Burazin et al. | 139/383 A |
| 2003/0118847 | A1* | 6/2003 | Chuang et al. | 428/447 |
| 2003/0157300 | A1* | 8/2003 | Burazin et al. | 428/152 |
| 2004/0055694 | A1* | 3/2004 | Kershaw et al. | 156/209 |
| 2005/0045293 | A1* | 3/2005 | Hermans et al. | 162/109 |
| 2005/0133175 | A1 | 6/2005 | Hada et al. | |

FOREIGN PATENT DOCUMENTS

| | | | |
|---|---|---|---|
| EP | 0 839 955 | A2 | 5/1998 |
| EP | 708857 | B1 * | 12/1998 |
| GB | 2279372 | A * | 1/1995 |
| WO | WO 9624718 | A1 * | 8/1996 |
| WO | WO 1997/032081 | A1 | 9/1997 |
| WO | WO 00/39394 | A1 | 7/2000 |
| WO | WO 2003071031 | A1 * | 8/2003 |
| WO | WO 2005068720 | A1 * | 7/2005 |

OTHER PUBLICATIONS

"Digital Surf," Internet web page http://www.digitalsurf.fr/en/index.html, viewed and printed prior to Jun. 2005, 1 page.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

TAPPI Provisional Method T 570 pm-00, "Resistance to Mechanical Penetration of Sanitary Tissue Papers (Ball Burst Procedure)," published by the TAPPI Press, Atlanta, Georgia, pp. 1-7.

TAPPI Provisional Method T 570 pm-00, "Resistance to Mechanical Penetration of Sanitary Tissue Papers (Ball Burst Procedure)," published by the TAPPI Press, Atlanta, Georgia, pp. 1-7. Date Unknown.

* cited by examiner

*Primary Examiner*—José A. Fortuna
(74) *Attorney, Agent, or Firm*—Gregory E. Croft

(57) ABSTRACT

A tissue product having a combination of substantially equal tensile energy absorbed (TEA) in the machine direction and the cross-machine direction of the tissue sheet and a significant level of stretch in both directions provides improved perception of strength and resistance to "poke through" in use.

30 Claims, 12 Drawing Sheets

TISSUE PRODUCTS HAVING SUBSTANTIALLY EQUAL MACHINE DIRECTION AND CROSS-MACHINE DIRECTION MECHANICAL PROPERTIES

This application is a continuation-in-part of U.S. Ser. No. 10/745,184 filed Dec. 23, 2003 now abandoned in the names of Hada et al. and entitled "Tissue Products Having Substantially Equal Machine Direction and Cross-Machine Direction Properties".

BACKGROUND OF THE INVENTION

In the field of tissue products, such as facial tissue, bath tissue, table napkins, paper towels and the like, the tensile strength of these sheet products is often measured as the geometric mean tensile strength (GMT), which takes into account the machine direction (MD) tensile strength and the cross-machine direction (CD) tensile strength. The GMT is calculated as the square root of the product of the MD and CD tensile strengths. However, using a single strength value to characterize a sheet can be misleading because the MD and CD tensile strength values are typically very different, with the MD tensile strength being much greater than the CD tensile strength. In use, the product is more likely to fail because its strength is limited by the weakest link, namely the CD tensile strength. In response, some prior emphasis has been made on making products in which the MD and CD tensile strengths of the sheets are the same, thereby eliminating sheet failure caused by a relatively weak CD tensile strength. Tissue sheets having equal MD and CD tensile strengths are typically referred to as being a "square" sheet. However, focusing on tensile strength alone ignores the key role that other properties play in the consumer's perception of strength. Therefore there is a need for a tissue sheet in which the perceived in-use strength is improved.

SUMMARY OF THE INVENTION

It has now been discovered that the perceived in-use strength of a tissue product can be improved by providing the product with one or more tissue sheets (plies) having substantially equal MD and CD tensile energy absorbed (TEA) (hereinafter defined) and a significant level of stretch, particularly in the CD direction of the sheet. The substantially equal TEA in combination with good stretch correlates with improved poke-through resistance for the tissue product, which is particularly important for bath tissue, but can be equally beneficial for facial tissue and towels. Poke-through resistance can be represented by the Normalized Burst Strength (hereinafter defined) of the tissue sheet, which takes into account the burst strength peak load and the geometric mean tensile energy absorbed (GM TEA).

Hence, in one aspect the invention resides in a tissue sheet having a three-dimensional surface topography, an MD/CD TEA ratio of from about 0.8 to about 1.2, more specifically from about 0.9 to about 1.1, still more specifically about 1.0, and a CD stretch of about 5 percent or greater. For purposes herein, a "three-dimensional surface topography" is a surface having a plurality, including random or regularly repeating, elevated and relatively depressed regions having an average z-directional elevation difference (peak-to-trough) of about 0.1 millimeter or greater, more specifically about 0.25 millimeter or greater, more specifically about 0.5 millimeter or greater, more specifically about 0.6 millimeter or greater, more specifically about 0.7 millimeter or greater, more specifically about 1.0 millimeter or greater, more specifically about 1.5 millimeters or greater and still more specifically from about 0.5 to about 1.5 millimeters. The z-direction elevation difference can be readily determined by non-compressive testing, such as by measuring the peak-to-trough distances from cross-sectional photographs of the sheet. The three-dimensional surface topography can be provided by embossing or by the use of highly contoured papermaking fabrics and serves to provide the tissue sheet with the necessary level of stretch and/or CD strength.

In another aspect, the invention resides in a tissue sheet having a Normalized Burst Strength of from about 20 to about 40 centimeters, more specifically from about 20 to about 35 centimeters, more specifically from about 25 to about 35 centimeters and still more specifically from about 25 to about 30 centimeters.

In another aspect, the invention resides in a bath tissue sheet having a three-dimensional surface topography, an MD/CD TEA ratio of from about 0.8 to about 1.2, a Normalized Burst Strength of from about 20 to about 40 centimeters, a CD stretch of from about 5 to about 20 percent, an MD stretch of from about 3 to about 30 percent, a GMT of from about 500 to about 1500 grams per 3 inches of width and a GM TEA of from about 2 to about 10 gram-centimeters per square centimeter.

The MD and CD tensile strengths of the sheets of this invention can be from about 400 to about 1500 grams or greater per 3 inches of sample width, more specifically from about 500 to about 1500 grams per 3 inches of sample width, more specifically from about 600 to about 1200 grams per 3 inches of sample width, more specifically from about 600 to about 1000 grams per 3 inches of sample width and still more specifically from about 600 to about 900 grams per 3 inches of sample width.

The geometric mean tensile strength (GMT) of the sheets of this invention can be about from about 500 to about 1500 grams per 3 inches of width, more specifically from about 550 to about 1200 grams per 3 inches of width, more specifically from about 600 to about 1000 grams per 3 inches of width and still more specifically from about 600 to about 900 grams per 3 inches of width.

The MD stretch for the sheets of this invention can be about 3 percent or greater, more specifically about 5 percent or greater, more specifically from about 3 to about 30 percent, more specifically from about 3 to about 25 percent, more specifically from about 3 to about 15 percent, and still more specifically from about 3 to about 10 percent.

The CD stretch for the sheets of this invention can be about 5 percent or greater, more specifically about 10 percent or greater, more specifically from about 5 to about 20 percent, more specifically from about 5 to about 15 percent, and still more specifically from about 5 to about 10 percent. Because the CD stretch of the sheets of this invention can be substantially increased by various factors, primarily including highly three-dimensional fabrics, and because the MD stretch can be reduced by various factors in order to make the MD TEA and CD TEA substantially equal, in many cases the CD stretch of the sheets of this invention will be greater than the MD stretch.

The GM TEA can be from about 2 to about 10 gram-centimeters per square centimeter, more specifically from about 2 to about 8 gram-centimeters per square centimeter, more specifically from about 2 to about 5 gram-centimeters per square centimeter and still more specifically from about 2 to about 4 gram-centimeters per square centimeter.

The basis weight of the tissue sheets of this invention can be from about 10 to about 45 grams per square meter (gsm), more specifically from about 10 to about 40 gsm, still more specifically from about 15 to about 35 gsm, more specifically from about 20 to about 35 gsm and still more specifically from about 30 to about 35 gsm.

The tissue sheets of this invention can be layered or non-layered (blended). Layered sheets can have two, three or more layers. For tissue sheets that will be converted into a single-ply product, it can be advantageous to have three layers with the outer layers containing primarily hardwood fibers and the inner layer containing primarily softwood fibers. Tissue sheets in accordance with this invention would be suitable for all forms of tissue products including, but not limited to, bathroom tissue, kitchen towels, facial tissue and table napkins for consumer and services markets.

Furthermore, to be commercially advantaged, it is desirable to minimize the presence of pinholes in the sheet. The degree to which pinholes are present can be quantified by the Pinhole Coverage Index, the Pinhole Count Index and the Pinhole Size Index, all of which are determined by an optical test method known in the art and described in U.S. Patent Application No. U.S. 2003/0157300 A1 entitled "Wide Wale Tissue Sheets and Method of Making Same", published Aug. 21, 2003, which is herein incorporated by reference. More particularly, the "Pinhole Coverage Index" is the arithmetic mean percent area of the sample surface area, viewed from above, which is covered or occupied by pinholes. For purposes of this invention, the Pinhole Coverage Index can be about 0.25 or less, more specifically about 0.20 or less, more specifically about 0.15 or less, and still more specifically from about 0.05 to about 0.15. The "Pinhole Count Index" is the number of pinholes per 100 square centimeters that have an equivalent circular diameter (ECD) greater than 400 microns. For purposes of this invention, the Pinhole Count Index can be about 65 or less, more specifically about 60 or less, more specifically about 50 or less, more specifically about 40 or less, still more specifically from about 5 to about 50, and still more specifically from about 5 to about 40. The "Pinhole Size Index" is the mean equivalent circular diameter (ECD) for all pinholes having an ECD greater than 400 microns. For purposes of this invention, the Pinhole Size Index can be about 600 or less, more specifically about 500 or less, more specifically from about 400 to about 600, still more specifically from about 450 to about 550. By way of example, current commercially available Charmin® bathroom tissue has a Pinhole Coverage Index of from 0.01-0.04, a Pinhole Count Index of from 250-1000, and a Pinhole Size Index of 550-650.

Suitable papermaking processes useful for making tissue sheets in accordance with this invention include uncreped through drying processes which are well known in the tissue and towel papermaking art. Such processes are described in U.S. Pat. No. 5,607,551 issued Mar. 4, 1997 to Farrington et al., U.S. Pat. No. 5,672,248 issued Sep. 30, 1997 to Wendt et al. and U.S. Pat. No. 5,593,545 issued Jan. 14, 1997 to Rugowski et al., all of which are hereby incorporated by reference. Throughdrying processes with creping, however, can also be used.

In the interests of brevity and conciseness, any ranges of values set forth in this specification contemplate all values within the range and are to be construed as support for claims reciting any sub-ranges having endpoints which are whole number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

TEST PROCEDURES

Tensile strengths and related parameters are measured using a crosshead speed of 254 millimeters per minute, a full scale load of 4540 grams, a jaw span (gauge length) of 50.8 millimeters and a specimen width of 76.2 millimeters. The MD tensile strength is the peak load per 3 inches of sample width when a sample is pulled to rupture in the machine direction. Similarly, the CD tensile strength represents the peak load per 3 inches of sample width when a sample is pulled to rupture in the cross-machine direction. For 1-ply products each tensile strength measurement is done on 1-ply. For multiple ply products tensile testing is done on the number of plies expected in the finished product. For example, 2-ply products are tested two plies at one time and the recorded MD and CD tensile strengths are the strengths of both plies. The same testing procedure is used for samples intended to be more than two plies.

More particularly, samples for tensile strength testing are prepared by cutting a 3 inches (76.2 mm) wide×5 inches (127 mm) long strip in either the machine direction or cross-machine direction orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10 and 90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is", and the arithmetic average of all individual specimen tests is either the MD or CD tensile strength for the product.

In addition to tensile strength, the stretch, tensile energy absorbed (TEA), and slope are also reported by the MTS TestWorks® for Windows Ver. 3.10 program for each sample measured. Stretch (either MD stretch or CD stretch) is reported as a percentage and is defined as the ratio of the slack-corrected elongation of a specimen at the point it generates its peak load divided by the slack-corrected gauge length. Slope is reported in the units of grams (g) and is defined as the gradient of the least-squares line fitted to the load-corrected strain points falling between a specimen-generated force of 70 to 157 grams (0.687 to 1.540 N) divided by the specimen width.

Total energy absorbed (TEA) is calculated as the area under the stress-strain curve during the same tensile test as has previously described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per centimeter and the area calculated by integration. The units of strain are centimeters per centimeter so that the final TEA units become g-cm/cm$^2$.

The "burst strength" of a tissue sheet is determined by an EJA Burst Tester (series # 50360) made by Thwing-Albert Instrument Company in Philadelphia, Pa. The test procedure is according to TAPPI T570 pm-00 except for the test speed. The test specimen is clamped between two concentric rings whose inner diameter defines the circular area under test. A penetration assembly the top of which is a smooth, spherical steel ball is arranged perpendicular to and centered under the rings holding the test specimen. The penetration assembly is raised at 6 inches per minute such that the steel ball contacts and eventually penetrates the test specimen to the point of specimen rupture. The maximum force (peak load) applied by the penetration assembly at the instant of specimen rupture is reported as the burst strength in grams (force) (sometimes abbreviated herein as "gf") of the specimen. An average value of six representative test specimens is the burst strength for the sample tissue sheet.

The penetration assembly consists of a spherical penetration member is a stainless steel ball with a diameter of 0.625±0.002 inch (15.88±0.05 mm) finished spherical to 0.00004 in (0.001 mm). The spherical penetration member is permanently affixed to the end of a 0.375+0.010 inch (9.525±0.254 mm) solid steel rod. A 2000 gram load cell is used and 50% of the load range, i.e. 0-1000 g, is selected. The distance of travel of the probe is such that the upper most surface of the spherical ball reaches a distance of 1.375 inches (34.9 mm) above the plane of the sample clamped in the test.

A means to secure the test specimen for testing consists of upper and lower concentric rings of approximately 0.25 inch (6.4 mm) thick aluminum between which the sample is firmly held by pneumatic clamps operated under a filtered air source at 60 psi. The clamping rings are 3.50±0.01 inch (88.9+0.3 mm) in internal diameter and approximately 6.5 inch (165 mm) in outside diameter. The clamping surfaces of the clamping rings are coated with a commercial grade of neoprene approximately 0.0625 inch (1.6 mm) thick having a Shore hardness of 70-85 (A scale). The neoprene need not cover the entire surface of the clamping ring but is coincident with the inner diameter, thus having an inner diameter of 3.50±0.01 inch (88.9±0.3 mm) and is 0.5 inch (12.7 mm) wide, thus having an external diameter of 4.5±0.01 inch (114±0.3 mm).

As used herein, the "Normalized Burst Strength" is the burst strength, as determined above in the unit of grams (force), divided by the geometric mean tensile energy absorbed (GM TEA) in the units of grams (force)-centimeter per square centimeter, resulting in the Normalized Burst Strength being expressed in units of centimeters.

BRIEF DESCRIPTION OF THE DRAWINGS

FIG. 4 is a plot of the MD/CD TEA ratio versus the MD/CD Tensile ratio.

FIG. 5 is the same plot as that of FIG. 4, but identifying the transfer fabric and throughdrying fabric used to produce the sheets of this invention.

FIG. 6 is a plot of the MD/CD TEA ratio versus MD stretch, illustrating the effect of different transfer fabrics and throughdrying fabrics.

FIG. 7 is a plot of the MD/CD TEA ratio versus the percent rush transfer.

FIG. 8 is a plot of the MD/CD TEA ratio versus CD stretch for the different transfer fabric and throughdrying fabric combinations.

FIG. 9 is a plot of the MD TEA versus the percent rush transfer.

FIG. 10 is a plot of the CD TEA versus the percent rush transfer.

FIG. 11 is a plot of the Normalized Burst Strength versus the MD/CD TEA ratio.

DETAILED DESCRIPTION OF THE DRAWINGS

Figure 1:
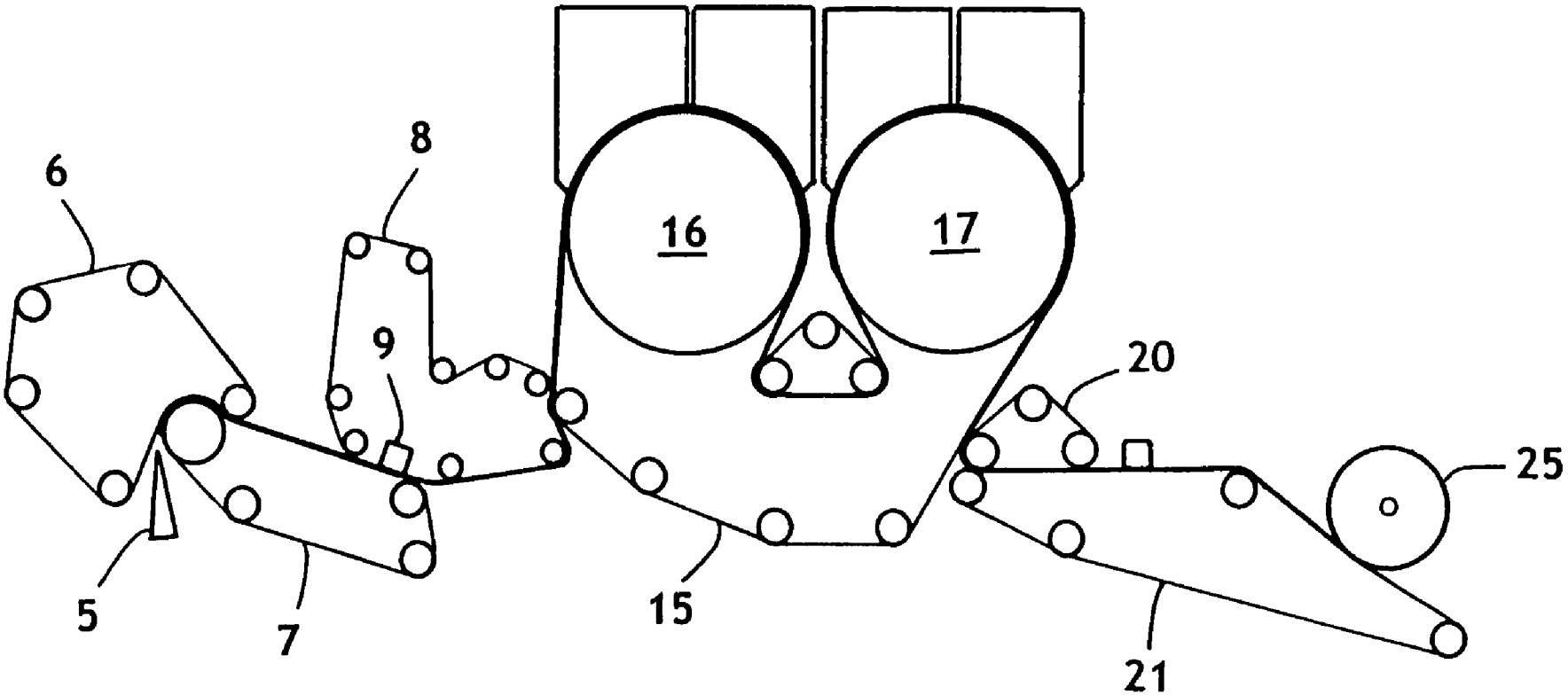
FIG. 1 is a schematic flow diagram of a tissue making process useful for making tissues in accordance with this invention.

Referring to FIG. 1, shown is an uncreped throughdried tissue making process in which a multi-layered headbox 5 deposits an aqueous suspension of papermaking fibers between forming wires 6 and 7. The newly-formed web is transferred to a slower moving transfer fabric 8 with the aid of at least one vacuum box 9. The level of vacuum used for the web transfers can be from about 3 to about 15 inches of mercury (76 to about 381 millimeters of mercury), preferably about 10 inches (254 millimeters) of mercury. The vacuum box (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum box(es).

The web is then transferred to a throughdrying fabric 15 and passed over throughdryers 16 and 17 to dry the web. The side of the web contacting the throughdrying fabric is referred to herein as the "fabric side" of the web. The opposite side of the web is referred to as the "air side" of the web. While supported by the throughdrying fabric, the web is final dried to a consistency of about 94 percent or greater. After drying, the sheet is transferred from the throughdrying fabric to fabric 20 and thereafter briefly sandwiched between fabrics 20 and 21. The dried sheet remains with fabric 21 until it is wound up at the reel 25. Thereafter, the tissue sheet can be unwound, calendered and converted into the final tissue product, such as a roll of bath tissue, in any suitable manner.

The various fabrics, particularly the throughdrying fabric and the transfer fabric, have a topographical structure that imparts three-dimensionality to the resulting tissue sheet or ply. This three-dimensionality in turn imparts CD stretch to the sheet because the three-dimensional bumps and/or ridges can be pulled out when the sheet is stressed. The MD stretch is also enhanced in part by the three-dimensionality, but to a greater extent the MD stretch is provided by the "rush" transfer of the newly-formed web from the faster moving forming fabric to the slower moving transfer fabric, or by creping if present.

Suitable three-dimensional fabrics useful for purposes of this invention are those fabrics having a top surface and a bottom surface. During wet molding and/or throughdrying, the top surface supports the wet tissue web. The wet tissue web conforms to the top surface and during molding is strained into a three-dimensional topographic form corresponding to the three-dimensional topography of the top surface of the fabric. Adjacent the bottom surface, the fabric has a load-bearing layer which integrates the fabric and provides a relatively smooth surface for contact with various tissue machine elements.

The transfer and TAD fabrics used herein have textured sheet-contacting surfaces comprising of substantially continuous machine-direction ridges separated by valleys and are similar to those described in U.S. Patent Application No. 2003/0157300 A1 published on Aug. 21, 2003 to Burazin et al., herein incorporated by reference. Furthermore, such fabrics with ridged sculpted layers can be extended to include ridges having a height of from 0.4 mm to about 5 millimeters, a ridge width of 0.5 mm or greater and a CD ridge frequency of from about 1.5 to about 8 per centimeter. Specific fabric styles described in this manner and included in the examples include Voith Fabrics t1205-1, t1207-6, t1203-1, and t1203-8.

Other suitable fabrics with topographical features are described by U.S. Pat. No. 5,429,686 issued on Jul. 4, 1995 to Chiu et al., of which fabric style Voith Fabrics t807-1 is one embodiment. Additional topographical fabrics with MD dominant features which can be utilized are described in U.S. Patent Application No. 2003/0084953 A1 published on May 8, 2003 to Burazin et al., herein incorporated by reference.

Fabrics can be woven or non-woven, or a combination of a woven substrate with an extruded sculpture layer which provides the topographical sculptured layer. Fabrics may also be finished so the warps are parallel to the cross-machine direction when run on a tissue machine, creating a series of substantially continuous cross-machine direction ridges separated by valleys.

Other fabrics suitable for use as the transfer fabric or the TAD fabric can have textured sheet-contacting surfaces comprising of a waffle-like pattern consisting of both machine-direction and cross-machine direction ridges with sculpted layers which have a peak height (from lowest element contacted by the tissue to the highest element) ranging from 0.5 mm to about 8 millimeters, and a frequency of occurrence of the two-dimensional pattern from about 0.8 to about 3.6 per square centimeter of fabric.

Figure 2:
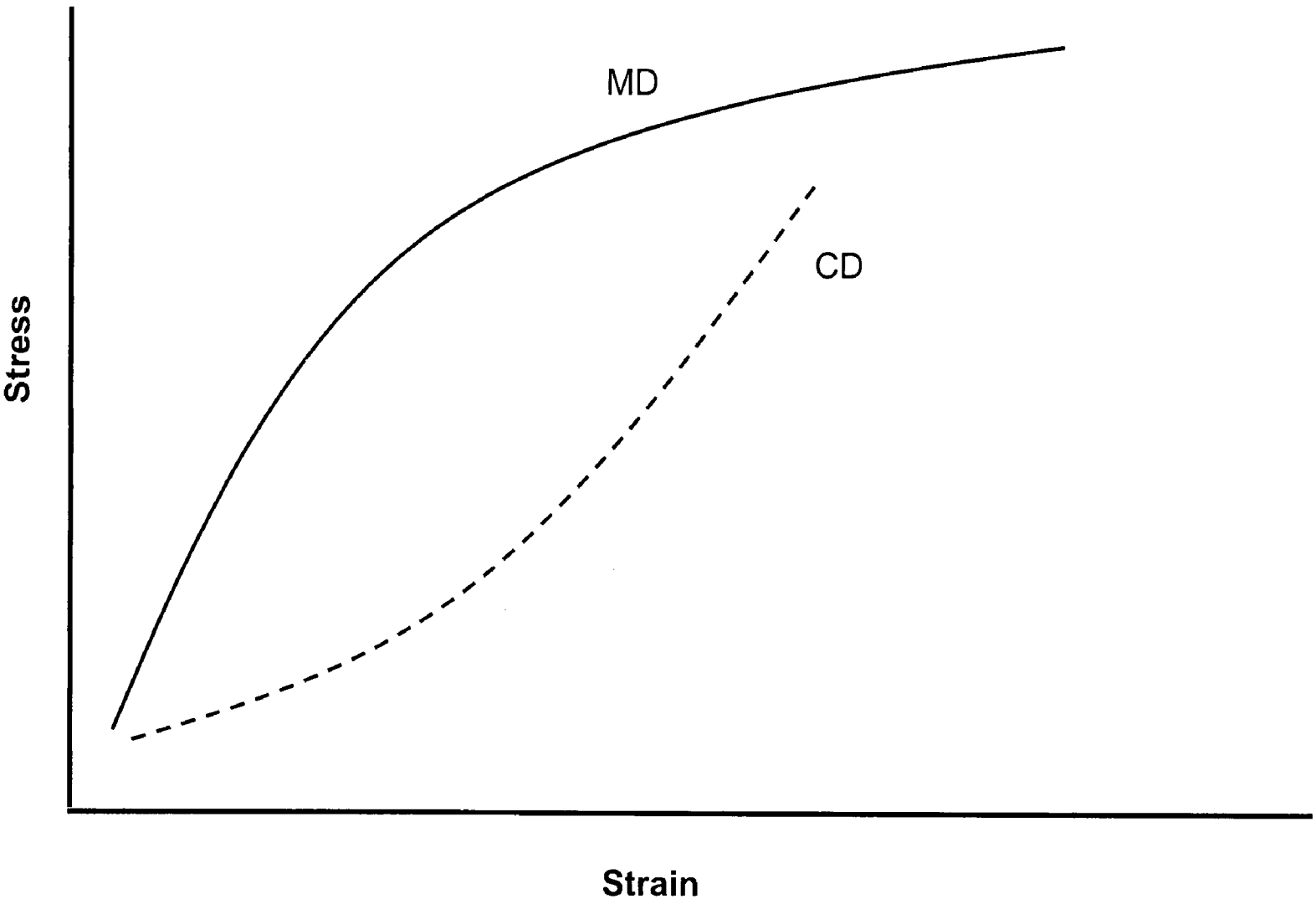
FIG. 2 is a schematic plot of a stress/strain curve to the breaking point (MD and CD) for a typical tissue sheet.

FIG. 2 illustrates MD and CD stress/strain curves for a typical tissue sheet having MD dominant topographical features. The MD curve may have a higher slope than the CD curve for a number of reasons, including fabric topography and fiber orientation. As shown, tissue sheets typically have greater strength in the MD and also greater stretch. One can see from these two curves that the area under the MD curve (the MD TEA) is greater than the area under the CD curve (the CD TEA).

The macro-structure of tissue often has a significant influence on the physical properties of the tissue. For example, when tissue is produced with MD-dominant topographic features, the result is often an increase in CD stretch relative to flat tissue, and a modification in the shape of the tensile stress-strain relationship. The relatively low stress at low strain for the CD curve is due to the low stress required to "pull out" the topography. The difference in shape between the MD and CD stress-strain curves is often a major reason for CD TEA deficiency.

Another factor affecting the shape of the MD and CD stress-strain curves is fiber orientation. Most paper products, including tissue, have more fibers oriented in the MD than the CD. Consequently, the MD stress-strain curve for flat (non-three-dimensional) tissue tends to be convex as the one depicted in FIG. 2. For these reasons, even when tissue is produced with equal MD and CD strength and equal MD and CD stretch, the shape difference between the stress-strain curves causes the MD/CD TEA ratio to be much greater than one.

Figure 3A:
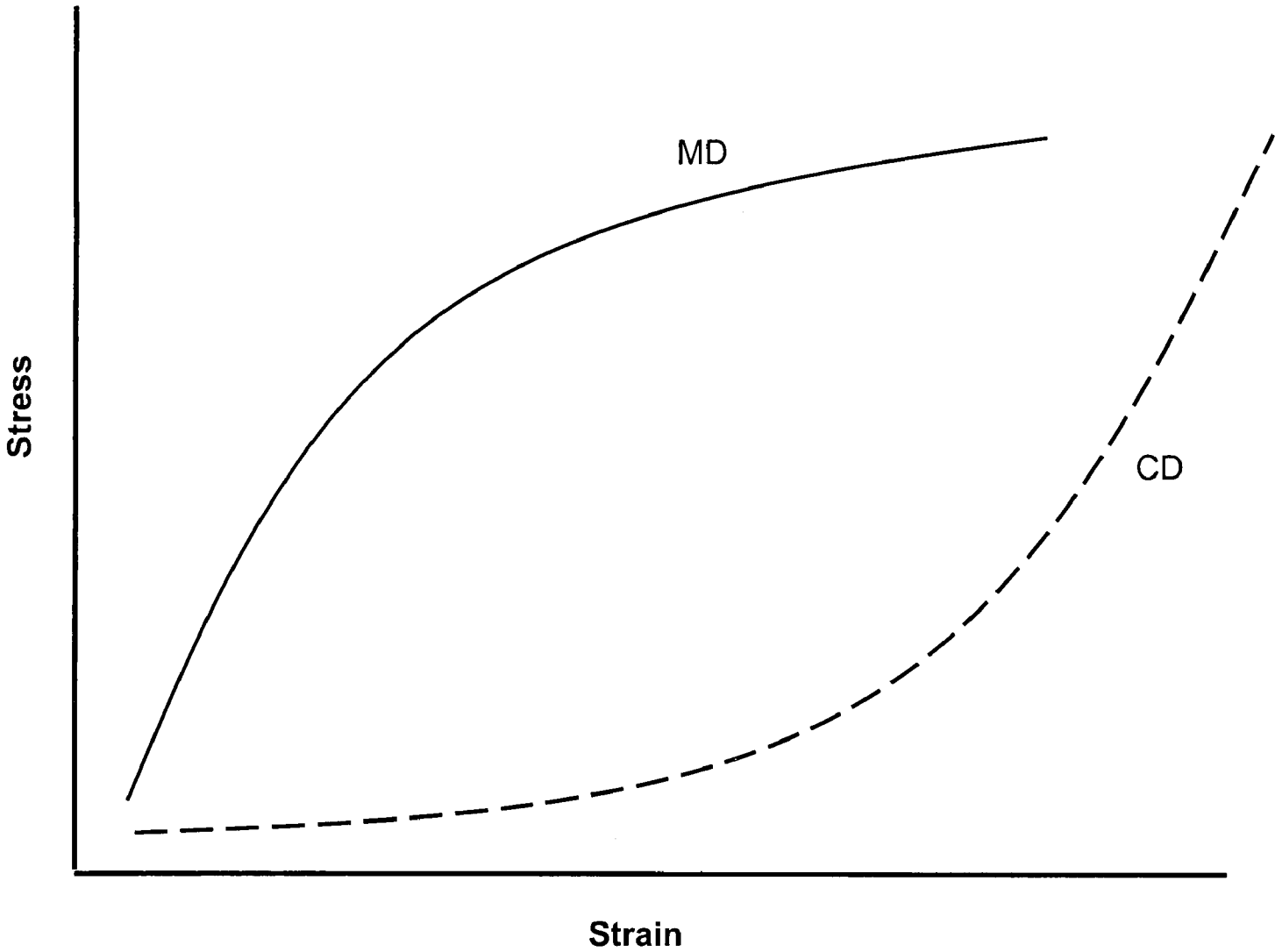
FIGS. 3A and 3B show schematic plots of stress/strain curves to the breaking point for different tissue sheets in accordance with this invention.
Figure 3B:
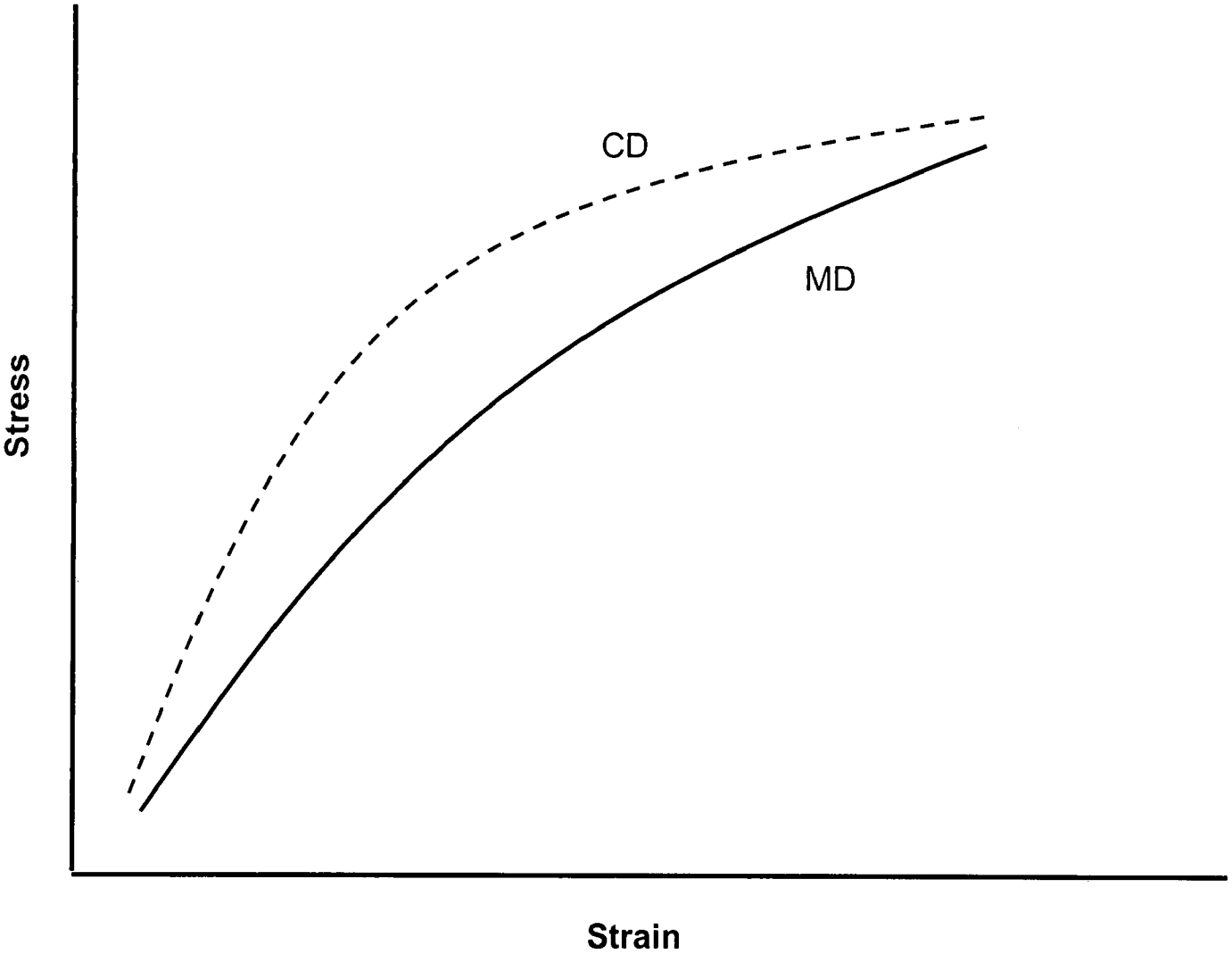

FIGS. 3A and 3B show two possible variations of the curves of FIG. 2 that represent tissue sheets of this invention. As shown, the solid line represents the MD tensile curve and the dashed line represents the CD tensile curve. In FIG. 3A, the dashed line represents one way of achieving a tissue sheet of this invention, which is to impart a higher degree of stretch into the CD of the sheet. By so doing, the area under the curve is increased relative to that shown in FIG. 2, such that the MD/CD TEA approaches unity. The dashed line in FIG. 3B represents another way of achieving a tissue sheet in accordance with this invention, in which the MD and CD stress/strain curves are more equal. This can be achieved by providing CD-dominant topographic features (features that are primarily oriented in the CD) through the use of three-dimensional throughdrying fabrics. In such cases, the stress at low strain values is decreased for the MD curve relative to that of FIG. 2 due to "pulling out" of the topography. Conversely, the stress at low strain for the CD curve is increased because the molded topographic features do not pull out as easily. Thus, sheets made in such a manner would have an MD/CD TEA ratio that is lower than sheets made with flat or MD-dominant topographic features.

Figure 4:
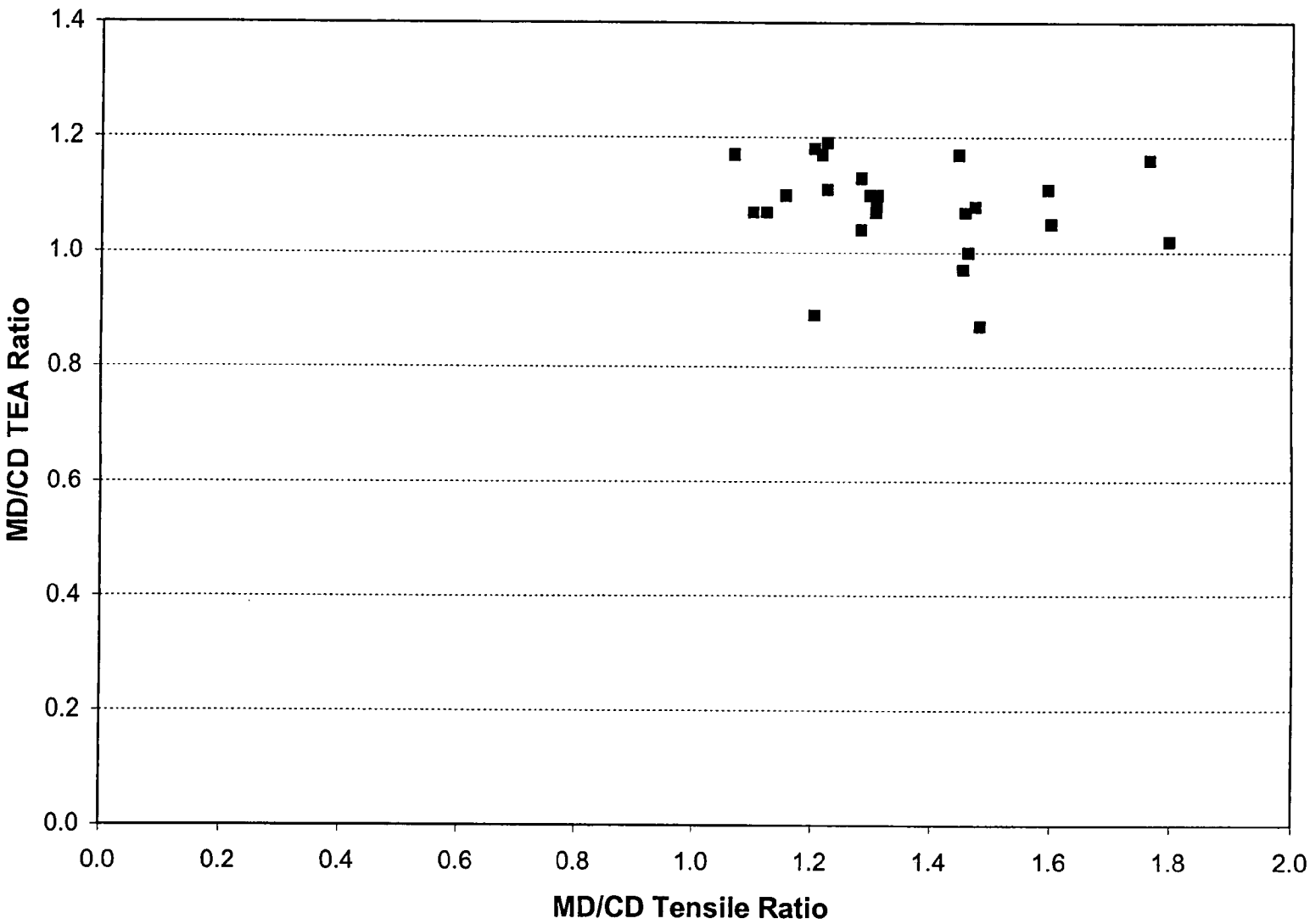
FIGS. 4-11 are plots of data generated by Examples 2-26. Specifically.

FIG. 4 illustrates the relationship between the MD/CD TEA ratio and MD/CD tensile strength ratio. The MD/CD tensile ratio was controlled by headbox conditions and rush transfer. The primary control variable for fiber orientation was the rheology of the slurry exiting the slice. The pilot paper machine used to manufacture these materials was a rush former. As such, the pulp slurry exiting the headbox slice was traveling at a higher velocity than the forming wire. To decrease the MD/CD tensile ratio, the slice was opened to maximum gap, thereby flooding the forming zone to minimize the rush of slurry onto the slower-moving forming fabric. In most cases, the forming zone was flooded to an extent that produced turbulent flow conditions during forming. Typical commercial paper machines are able to control the MD/CD tensile ratio without turbulent flow due to more complex control systems. It is important to note that there is not direct correlation between the MD/CD TEA ratio and the MD/CD tensile ratio. Also, it is not possible to infer the MD/CD TEA ratio based on the MD/CD tensile strength ratio and the MD or CD stretch.

Figure 5:
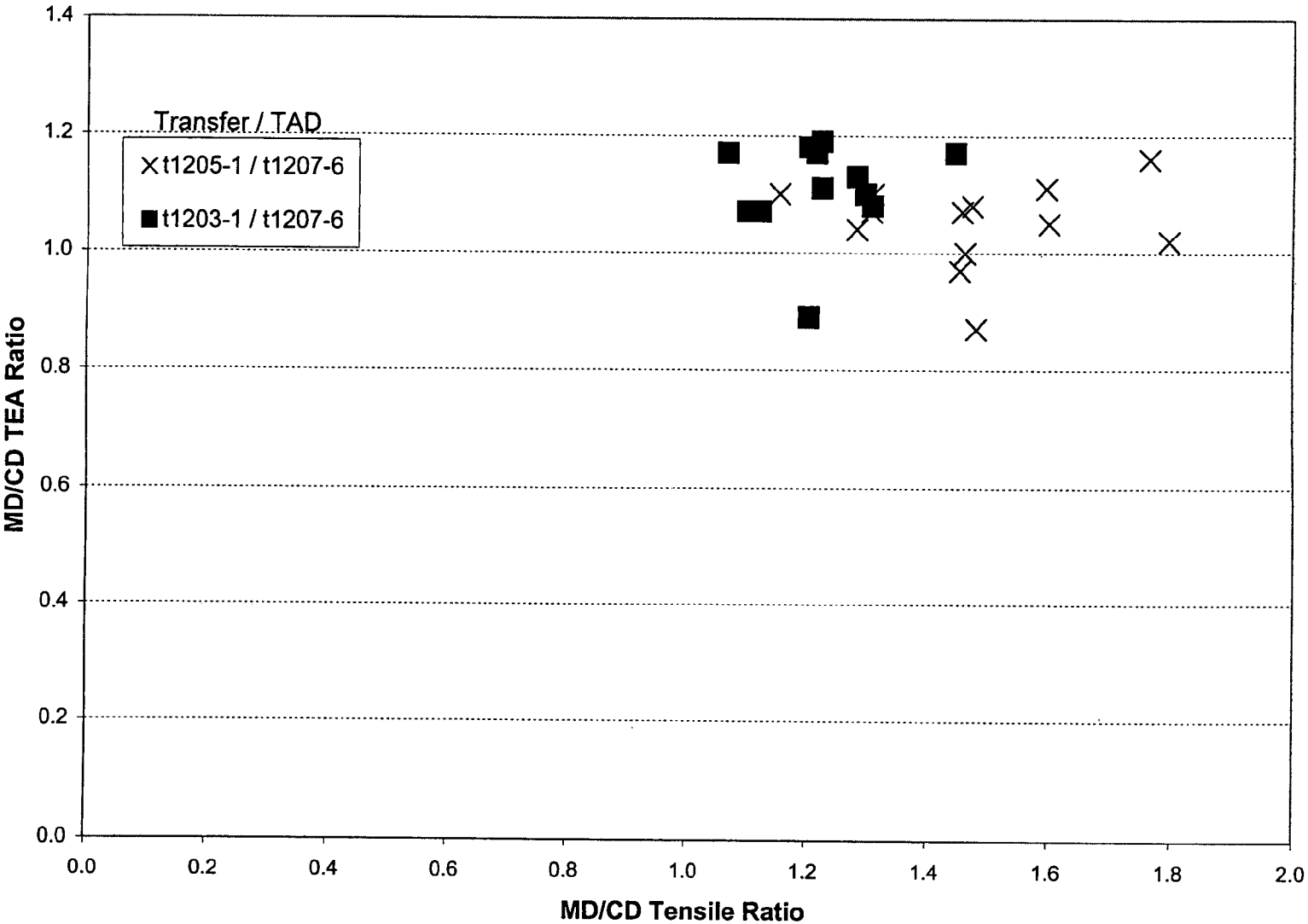

FIG. 5 illustrates the significant effect on the strength properties of the sheet as a function of the transfer and TAD fabrics used. By applying topographic transfer fabrics, samples made from several fabric combinations achieved MD/CD TEA values near 1.0 for a wide range of MD/CD Tensile ratios. As a means of illustration, the t1205-1 fabric has 3.02 ripples/cm and a ridge height of approximately 0.8 mm. The t1203-1 fabric has 2.03 ripples/cm and a ridge height of approximately 1.1 mm.

Figure 6:
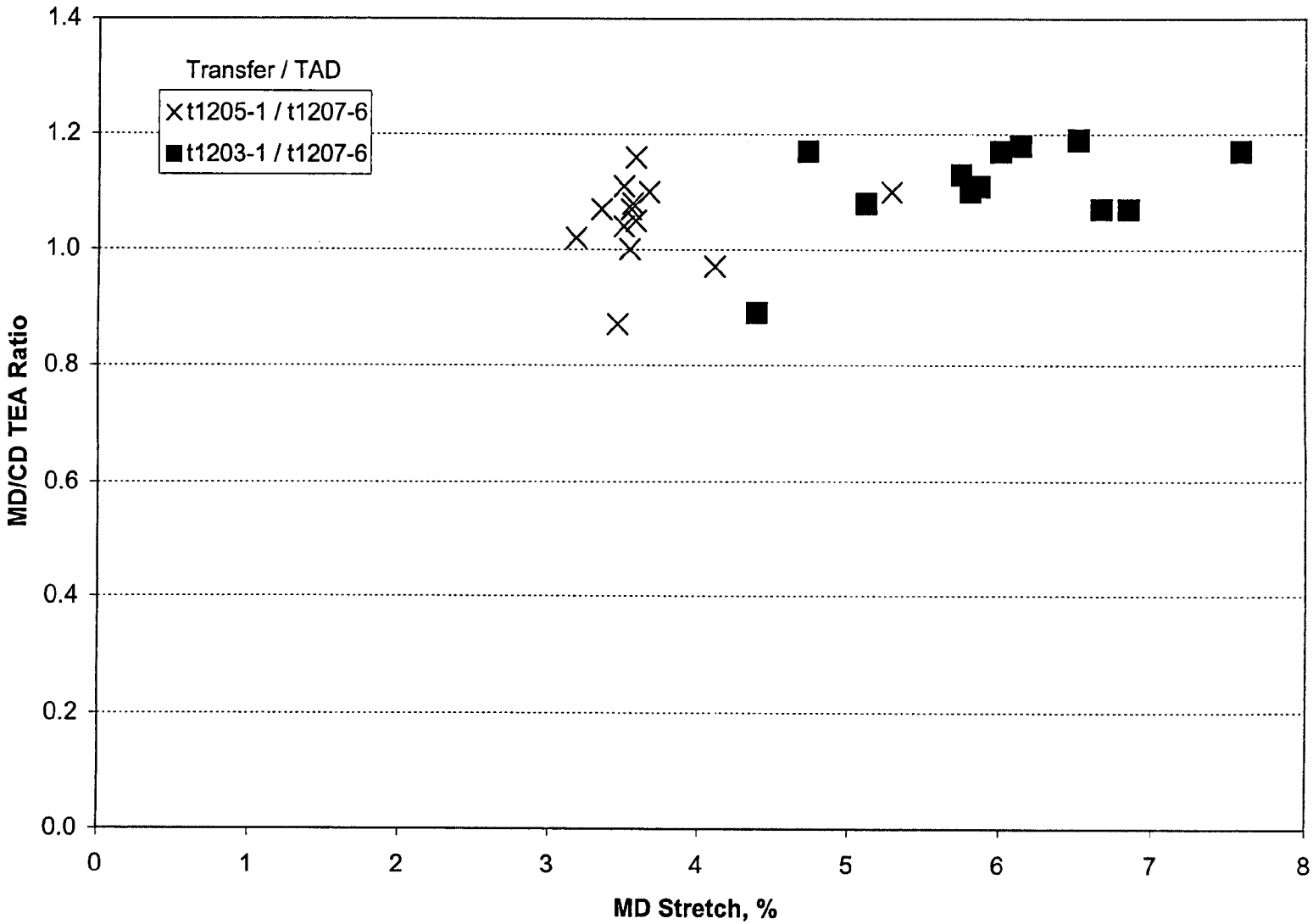

FIG. 6 illustrates the relationship between MD stretch and MD/CD TEA ratio for the samples of this invention produced in the Examples. While the MD TEA generally increases when the MD stretch increases, this relationship was not observed for the samples produced. Instead, the samples of this invention having a substantially equal MD/CD TEA ratio were produced over a wide range of MD stretch. The MD stretch was controlled by rush transfer between the forming fabric and transfer fabric. No attempt was made to remove MD stretch by increasing draw at the reel. The greater topography (higher CD strain) transfer fabric (t1203-1) allowed for an increase in MD stretch while maintaining an MD/CD TEA ratio near one. The trend of obtaining higher stretch with greater topography (CD strain) transfer fabric, at an MD/CD ratio of approximately 1, would be expected to continue with the use of transfer fabrics having greater topography than that of the t1203-1 fabric. Examples of such fabrics would be the Voith Fabrics t1203-4 and the t1203-6, which both have higher ridge height than the t1203-1.

Figure 7:
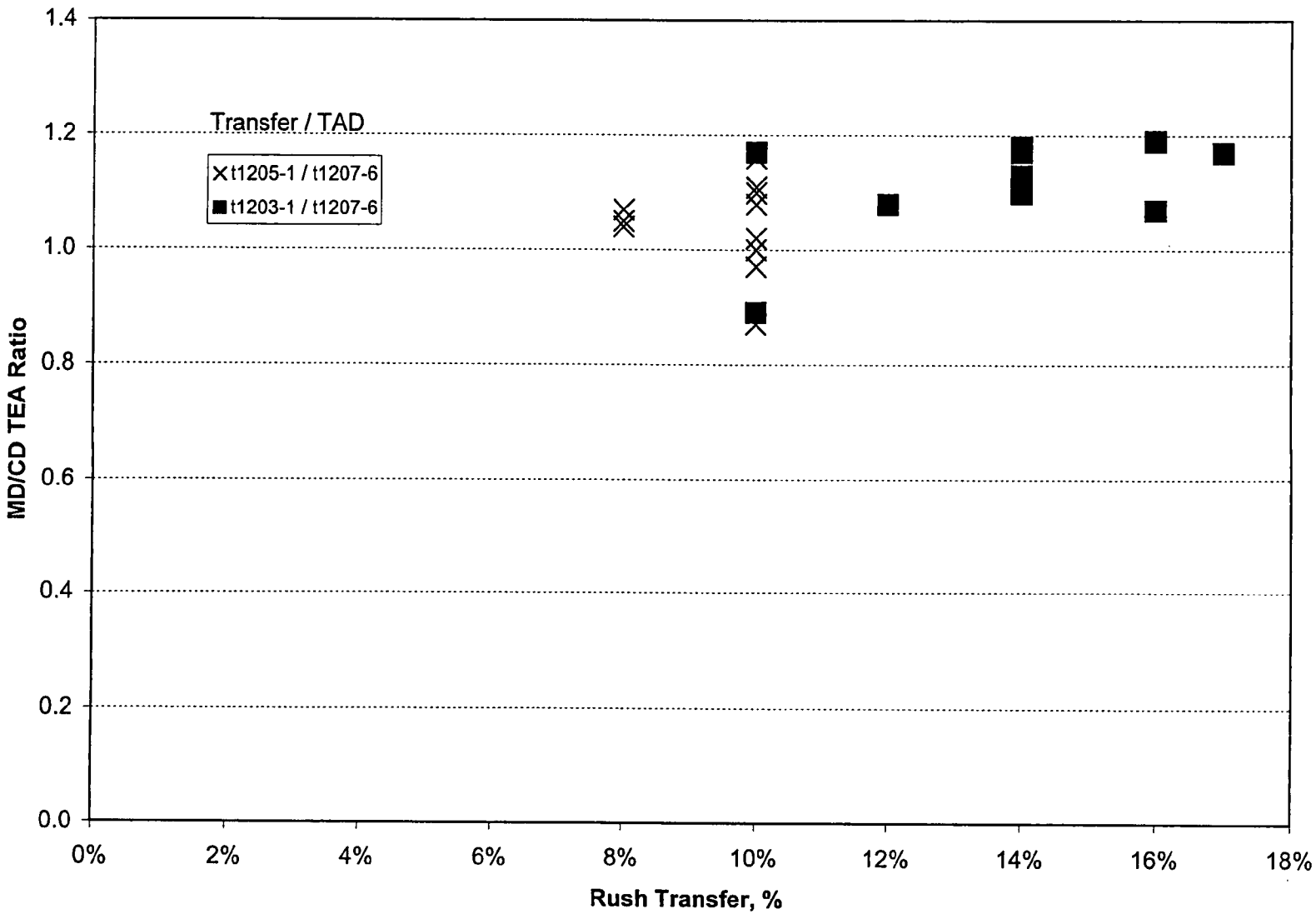

FIG. 7 illustrates the effect of rush transfer between the forming fabric and the transfer fabric on the MD/CD TEA ratio. As shown, the MD/CD TEA ratio was constant over a wide range of rush transfer level. Additionally, increasing transfer fabric topography from t1205-1 to t1203-1 allowed for higher levels of rush transfer while maintaining a low MD/CD TEA ratio.

Figure 8:
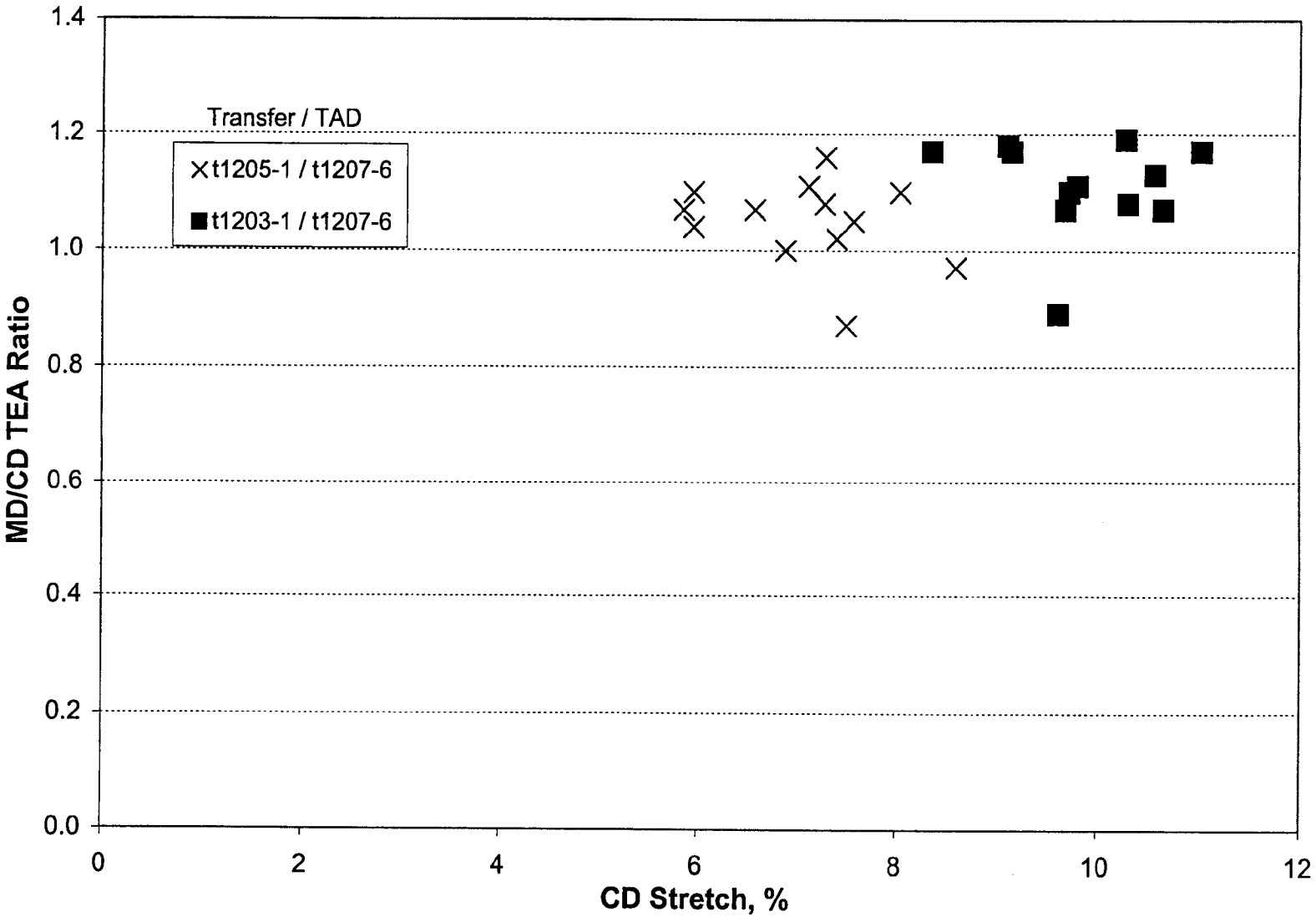

FIG. 8 depicts the relationship between MD/CD TEA ratio and CD stretch. CD stretch appears to have little impact on the MD/CD TEA ratio. Therefore sheets of the invention can be produced over a wide range of CD stretch values. It can be noted that higher topographical fabrics (t1203-1 as compared to the t1205-1) allow for higher CD stretch and higher MD stretch (FIG. 6) at equivalent MD/CD TEA ratio. Using even higher topographical fabrics in the transfer position would allow for even higher MD and CD stretch at an MD/CD TEA ratio of one.

Figure 9:
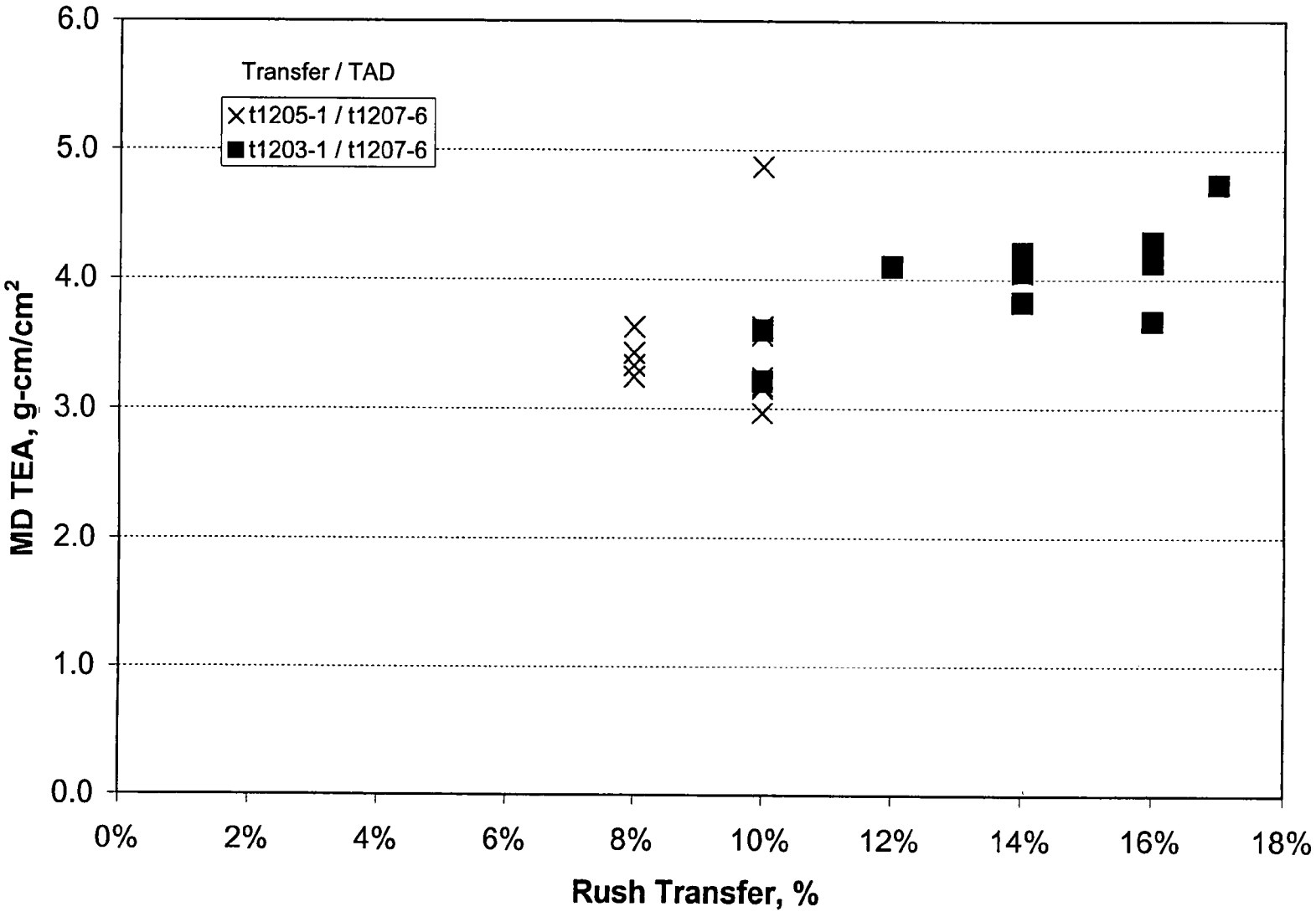

FIG. 9 illustrates the relationships between MD TEA and rush transfer for the two fabric combinations used in these examples. Within a combination of fabrics, the MD TEA increases slightly with increasing rush transfer. Rush transfer was found to have a direct and inverse effect on MD stretch and strength. Specifically, as rush transfer increases, MD stretch increases, and MD strength decreases. The rush transfer level at which MD TEA is optimized depends on the transfer and TAD fabrics used.

Figure 10:
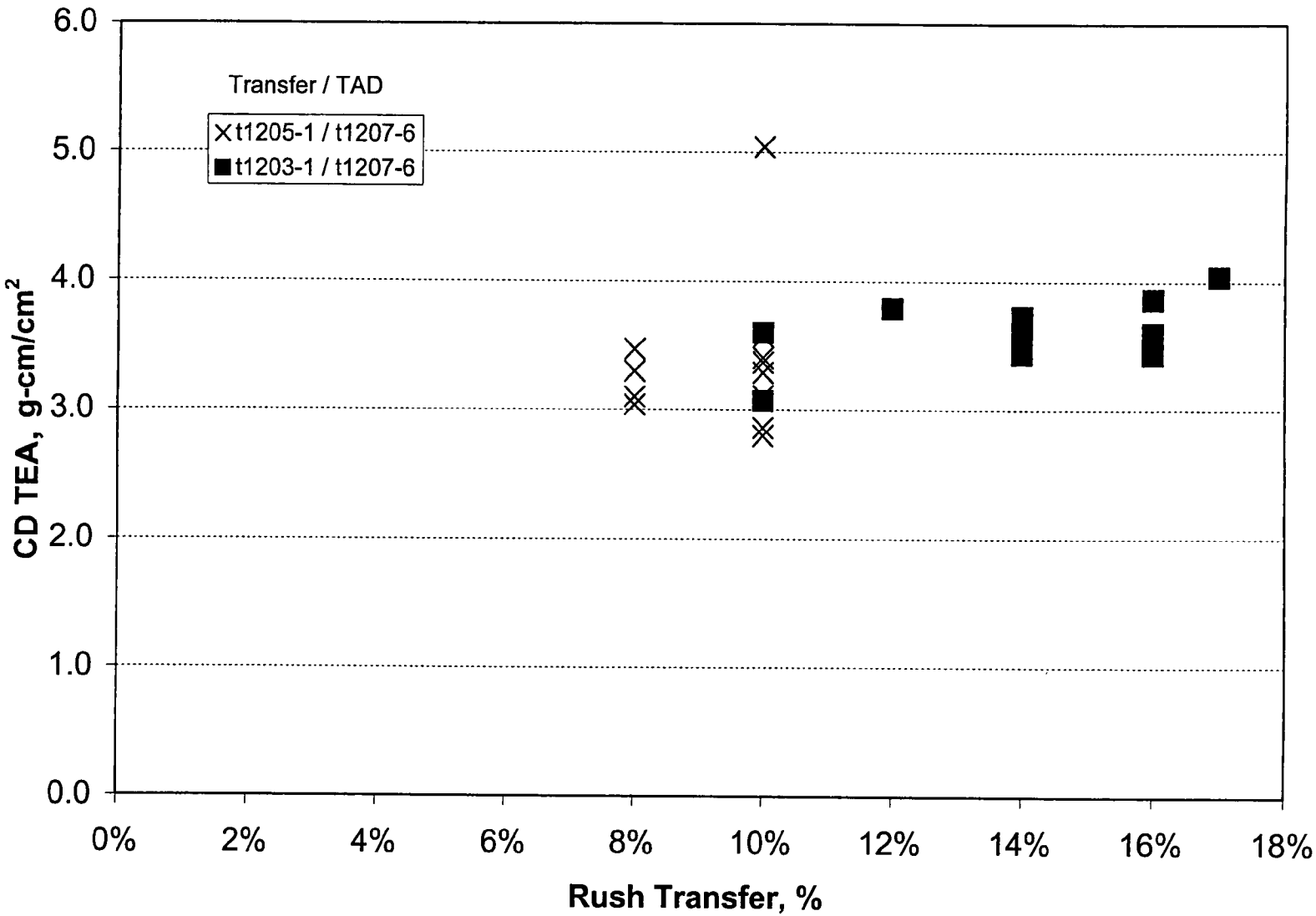

FIG. 10 illustrates the relationships between CD TEA and rush transfer for the two fabric combinations used in these examples. Within a combination of fabrics, the CDTEA increases slightly with increasing rush transfer.

Figure 11:
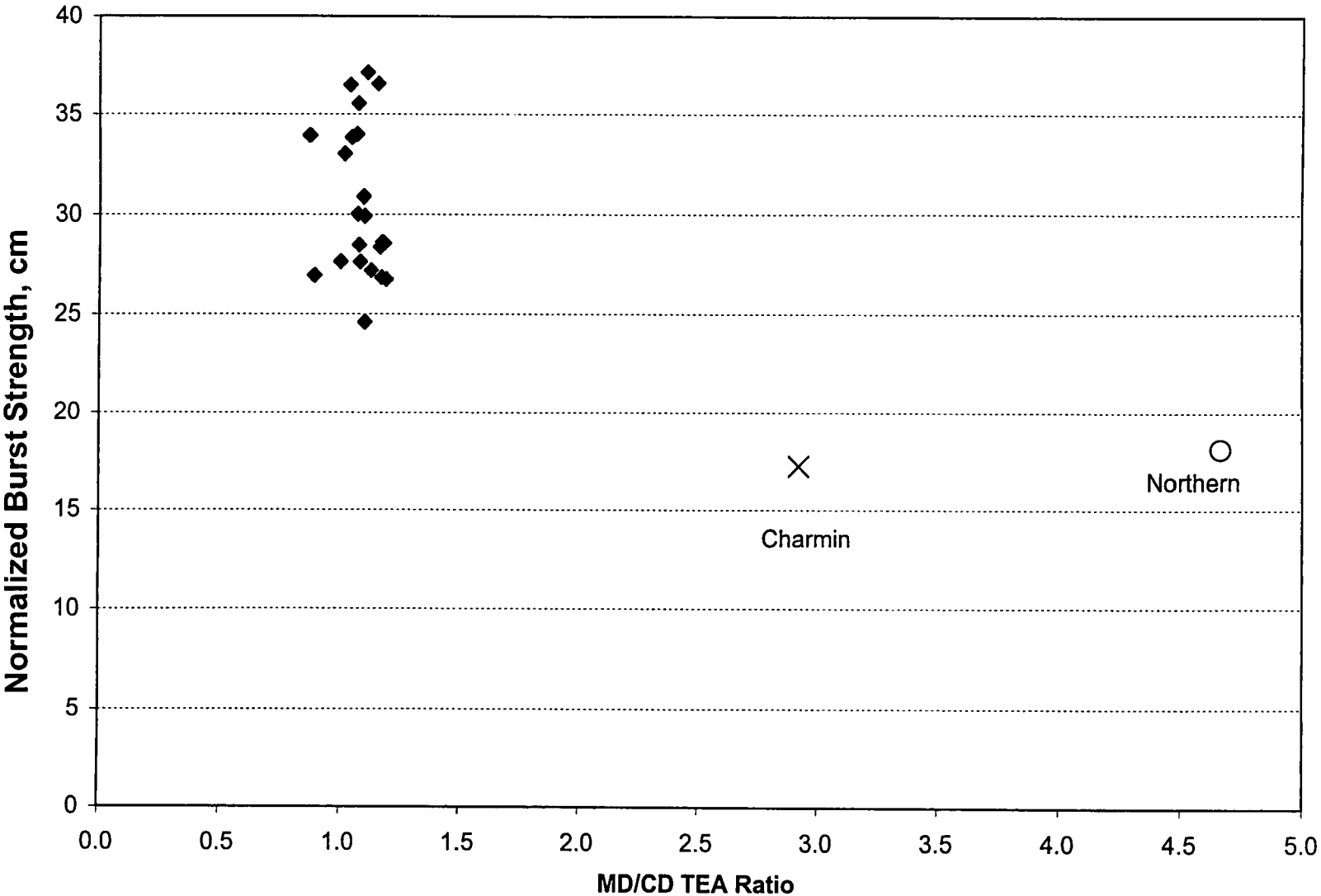

FIG. 11 illustrates the relationship between Normalized Burst Strength as a function of the MD/CD TEA ratio for the tissue sheets of this invention as compared to two commercially-available bath tissue products. As shown, the tissue sheets of this invention have a significantly higher Normalized Burst Strength compared to the commercial bath tissues. This maximizes consumer-perceived strength (durability) for a given level of tensile strength.

EXAMPLES

Example 1

Hypothetical

The need for significant stretch (about 5 percent or greater) is an important factor for purposes of this invention because it is relatively easy to remove stretch and lower tensile strength in the MD to make those properties equal to the stretch and tensile strength in the CD, thereby resulting in an equal or substantially equal MD TEA and CD TEA. However, since stretch and strength are much more difficult to generate in the CD, merely making these properties equal would only provide a weak sheet with low stretch with little or no consumer benefit. To illustrate this point, hypothetical products are listed in Table 1 below showing the effect of their properties on TEA.

TABLE 1

| Product | MD Tensile g/3" | CD Tensile g/3" | MD Stretch % | CD Stretch % | MD TEA g-cm/cm$^2$ | CD TEA g-cm/cm$^2$ |
|---|---|---|---|---|---|---|
| A | 1000 | 800 | 15 | 5 | 9.8 | 2.6 |
| B | 800 | 800 | 5 | 5 | 2.6 | 2.6 |
| C | 800 | 800 | 10 | 10 | 5.2 | 5.2 |

The hypothetical examples are assumed to have a linear stress-strain curve which is not usually the case for tissue products, which have stress-strain curves with varying shapes depending on the method of manufacture and the specific fabrics and chemicals used to impart stretch and strength to the product. However, using a linear stress-strain curve allows a direct calculation of the tensile energy absorbed to better illustrate the usefulness of this invention. Note that it is not possible to directly calculate TEA for real products from the strength and stretch properties where the shape of the stress-strain curve is not known. However, this example serves to illustrate that a substantially equal MD TEA and CD TEA is a useful property that cannot be inferred directly from strength properties.

Referring to Table 1, product "A" is a typical product made today where the MD tensile and stretch is higher than the CD tensile and stretch. Since the MD and CD TEAs are products of tensile and stretch, the MD TEA is almost four times that of the CD TEA.

The product would fail when the CD TEA of 2.6 is reached. Product "B" is the same as product "A" where the MD tensile has been pulled out to make the MD and CD tensile and stretch the same. The product now has equal MD and CD TEA values, hence giving maximum utility for a given tensile strength and stretch. But while the MD and CD TEA are equal, they are relatively low, giving the consumer the perception that the product is only moderately strong. An additional improvement is made in product "C", where the stretch is increased while keeping the tensile the same as that of product "B". This results in a product with double the TEA when compared to product "B". More importantly, product "C" also has double the TEA of product "A" in the weaker direction.

Examples 2-26

To further illustrate the invention, a pilot uncreped throughdried tissue machine was configured similarly to that illustrated in the aforementioned Rugowski et al. patent and was used to produce a one-ply, uncreped throughdried bath tissue basesheet. More specifically, 100 pounds of bleached northern softwood kraft fiber were dispersed in a pulper for 30 minutes at a consistency of 3 percent. Similarly, 100 pounds of bleached eucalyptus were dispersed in a pulper for 30 minutes at a consistency of 3 percent. The thick stock was then sent to a machine chest and diluted to a consistency of about 1 percent.

The machine chest furnish was diluted to approximately 0.1% consistency and delivered to a forming fabric using a three-layered headbox. The forming fabric speed was approximately 62 fpm. The resulting web was then transferred to a transfer fabric traveling at the same or slower than the forming fabric using a vacuum shoe to assist the transfer. At a second vacuum shoe assisted transfer, the web was delivered onto a throughdrying fabric. The web was dried with a throughdryer operating at a temperature of 375° C.

Bath tissue basesheet was produced with an oven-dry basis weight of approximately 26 gsm. The resulting product was equilibrated for at least 4 hours in TAPPI standard conditions (73° F., 50% relative humidity) before tensile testing. All testing was performed on basesheet from the pilot machine without further processing.

The process conditions are shown in Table 2. The resulting product tensile properties are reported in Table 3. The results are also plotted in FIGS. 4-11, previously discussed.

Because peak tensile strength affects TEA, it would be expected that tissue with a greater MD/CD ratio would have a greater MD/CD TEA ratio. As the data in FIG. 4 show, substantially equal MD/CD TEA ratio samples were produced over a large range of MD/CD tensile. The relationship between MD/CD tensile ratio and MD/CD TEA ratio is complex. FIGS. 4-11 provide insight into the complicated relationships between tissue machine fabrics, rush transfer levels, and tensile strength properties that influence the MD/CD TEA ratio.

TABLE 2

| Example | Transfer Fabric | TAD Fabric | Vacuum Transfer 1" Hg | Vacuum Transfer 2" Hg | TAD Speed ft/min | Rush Transfer | Emveco Caliper mils | Ambient BW gsm | Headbox H2O Flow gpm |
|---|---|---|---|---|---|---|---|---|---|
| 2 | t1205-1 | t1207-6 | 11.5 | 8.7 | 50 | 14% | 22.1 | 28 | 45.0 |
| 3 | t1205-1 | t1207-6 | 11.6 | 6.5 | 50 | 8% | 20.9 | 28 | 45 |
| 4 | t1205-1 | t1207-6 | 13 | 4.75 | 70 | 8% | 19.2 | 28 | 45 |
| 5 | t1205-1 | t1207-6 | 13.1 | 4.9 | 70 | 8% | 19.1 | 28 | 45 |
| 6 | t1205-1 | t1207-6 | 13.2 | 5 | 70 | 8% | 18.2 | 28 | 45 |
| 7 | t1205-1 | t1207-6 | 13.4 | 5.1 | 70 | 10% | 18.7 | 28 | 45 |
| 8 | t1205-1 | t1207-6 | 12.8 | 8.1 | 70 | 10% | 20.1 | 28 | 45 |
| 9 | t1205-1 | t1207-6 | 12.5 | 10 | 70 | 10% | 22.5 | 28 | 45 |
| 10 | t1205-1 | t1207-6 | 12.5 | 10 | 70 | 10% | 22 | 28 | 55 |
| 11 | t1205-1 | t1207-6 | 12.5 | 10 | 70 | 10% | 22 | 28 | 55 |
| 12 | t1205-1 | t1207-6 | 12.5 | 10 | 70 | 10% | 22.6 | 28 | 35 |
| 13 | t1205-1 | t1207-6 | 12.5 | 10 | 70 | 10% | 22.6 | 28 | 35 |
| 14 | t1203-1 | t1207-6 | 11.5 | 3.5 | 60 | 10% | 23.1 | 28 | 45 |
| 15 | t1203-1 | t1207-6 | 11 | 8.9 | 60 | 17% | 26.3 | 28 | 45 |
| 16 | t1203-1 | t1207-6 | 11.2 | 9.4 | 60 | 16% | 25.9 | 28 | 45 |
| 17 | t1203-1 | t1207-6 | 11.6 | 9.9 | 60 | 14% | 24.4 | 28 | 45 |
| 18 | t1203-1 | t1207-6 | 11.7 | 8.4 | 60 | 14% | 25 | 28 | 45 |
| 19 | t1203-1 | t1207-6 | 12.5 | 5.2 | 60 | 14% | 23.6 | 28 | 45 |
| 20 | t1203-1 | t1207-6 | 11.6 | 11.7 | 60 | 14% | 26.5 | 28 | 45 |
| 21 | t1203-1 | t1207-6 | 11.4 | 11.7 | 60 | 16% | 27.1 | 28 | 45 |
| 22 | t1203-1 | t1207-6 | 11.6 | 11.7 | 60 | 12 | 26.3 | 28 | 45 |
| 23 | t1205-1 | t1207-6 | 13.2 | 3.7 | 50 | 10 | 21.4 | 34 | 45 |
| 24 | t1203-1 | t1207-6 | 10.5 | 8.4 | 60 | 10 | 24.6 | 28 | 45 |
| 25 | t1203-1 | t1207-6 | 11.2 | 9.4 | 60 | 16 | 26.2 | 28 | 45 |
| 26 | t1203-1 | t1207-6 | 11.3 | 9.5 | 60 | 14 | 26 | 28 | 45 |

TABLE 3

| Example | MD Dry Tensile g/3" | MD Stretch % | MD Tensile Slope g/3" | MD TEA g · cm/ cm2 | CD Dry Tensile g/3" | CD Stretch % | CD Tensile Slope g/3" | CD TEA g · cm/ cm2 | Tensile MD/CD | GMT g/3" | MDTEA/ CDTEA |
|---|---|---|---|---|---|---|---|---|---|---|---|
| 2 | 749 | 5.29 | 17.2 | 4.05 | 648.3 | 8.04 | 5.39 | 3.68 | 1.16 | 697 | 1.10 |
| 3 | 1042.9 | 3.58 | 27.81 | 3.63 | 651.5 | 7.57 | 6.1 | 3.47 | 1.60 | 824 | 1.05 |
| 4 | 909.51 | 3.55 | 27.49 | 3.246 | 623.9 | 6.58 | 6.77 | 3.04 | 1.46 | 753 | 1.07 |
| 5 | 941.6 | 3.35 | 28.27 | 3.332 | 719.8 | 5.86 | 8.22 | 3.101 | 1.31 | 823 | 1.07 |
| 6 | 991.3 | 3.5 | 24.21 | 3.43 | 772.4 | 5.96 | 8.51 | 3.3 | 1.28 | 875 | 1.04 |
| 7 | 1029.6 | 3.67 | 26.4 | 3.604 | 785.8 | 5.96 | 8.21 | 3.29 | 1.31 | 899 | 1.10 |
| 8 | 984.1 | 3.56 | 25.14 | 3.63 | 667.5 | 7.28 | 6.07 | 3.37 | 1.47 | 810 | 1.08 |
| 9 | 881.4 | 3.5 | 20.71 | 3.18 | 552.3 | 7.12 | 5.84 | 2.86 | 1.60 | 698 | 1.11 |
| 10 | 1028.8 | 3.54 | 24.51 | 3.57 | 703.4 | 6.89 | 7.06 | 3.57 | 1.46 | 851 | 1.00 |
| 11 | 890.6 | 3.46 | 22.08 | 2.966 | 601 | 7.5 | 5.89 | 3.403 | 1.48 | 732 | 0.87 |
| 12 | 951.8 | 3.58 | 23.17 | 3.239 | 539.1 | 7.29 | 5.56 | 2.8 | 1.77 | 716 | 1.16 |
| 13 | 1009.2 | 3.18 | 29.87 | 3.16 | 561.3 | 7.4 | 5.74 | 3.11 | 1.80 | 753 | 1.02 |
| 14 | 745.65 | 4.73 | 15.31 | 3.605 | 515.6 | 8.36 | 4.19 | 3.07 | 1.45 | 620 | 1.17 |
| 15 | 611 | 7.58 | 11.05 | 4.734 | 572 | 11.04 | 3.22 | 4.04 | 1.07 | 591 | 1.17 |
| 16 | 574.4 | 6.67 | 8.94 | 3.676 | 511.58 | 9.69 | 3.58 | 3.43 | 1.12 | 542 | 1.07 |
| 17 | 714 | 5.81 | 12.21 | 4.113 | 550.2 | 9.73 | 3.59 | 3.73 | 1.30 | 627 | 1.10 |
| 18 | 687.6 | 6.14 | 11.87 | 4.057 | 571.1 | 9.12 | 3.98 | 3.433 | 1.20 | 627 | 1.18 |
| 19 | 736.5 | 6.01 | 12.38 | 4.207 | 605.2 | 9.16 | 4.08 | 3.61 | 1.22 | 668 | 1.17 |
| 20 | 730.4 | 5.75 | 13.2 | 4.205 | 569.11 | 10.58 | 3.42 | 3.73 | 1.28 | 645 | 1.13 |
| 21 | 656.5 | 6.52 | 10.86 | 4.289 | 535.8 | 10.29 | 3.48 | 3.602 | 1.23 | 593 | 1.19 |
| 22 | 748.8 | 5.12 | 16.14 | 4.1 | 572.1 | 10.31 | 3.43 | 3.79 | 1.31 | 655 | 1.08 |
| 23 | 1224.8 | 4.11 | 31.28 | 4.87 | 842.2 | 8.6 | 6.64 | 5.04 | 1.45 | 1016 | 0.97 |
| 24 | 684.7 | 4.39 | 16.09 | 3.209 | 568.4 | 9.62 | 3.73 | 3.6 | 1.20 | 624 | 0.89 |
| 25 | 606 | 6.85 | 10.08 | 4.132 | 550.6 | 10.66 | 3.25 | 3.865 | 1.10 | 578 | 1.07 |
| 26 | 666 | 5.87 | 12.11 | 3.824 | 543.43 | 9.81 | 3.66 | 3.46 | 1.23 | 602 | 1.11 |

In general, many different factors can be manipulated to produce the products having an MD TEA and CD TEA which are substantially equal. These factors include the MD and CD tensile strength, the topography of the transfer and throughdrying fabrics, chemicals, rush/drag forming (jet-to-wire ratio), forming consistency, percent rush transfer, creping variables, vacuum levels, fiber species, pulping conditions, hardwood/softwood ratio, refining level and reeling (percent stretch pullout).

As the MD TEA is normally higher, emphasis must be placed on manipulating these factors to increase the CD TEA to make it substantially equal to the MD TEA. How each of these factors must be manipulated is process dependent, and adjustments may need to be made differently for different processes. However, some general statements can be made about methods to generate essentially equal MD and CD TEA.

In this respect, the CD tensile strength can often be increased by increasing the percent hardwood in the furnish. More hardwood relative to softwood will tend to decrease the MD/CD tensile ratio, thus making the TEA closer to equal.

Concerning the fabric topography, the effect on MD/CD TEA is complex and dependent on several factors such as the papermaking fabric weave pattern. For fabrics having MD-oriented topographical features, increasing the height of the fabric topography may increase CD TEA and hence make MD and CD TEA more equal by increasing the percent stretch in the CD. However, the effect on the shape of the CD stress/strain curve must be considered, and hence this effect is not true for all fabric designs.

As to the jet-to-wire ratio, the MD/CD tensile ratio generally follows a well-known "U" shape as the jet-to-wire ratio is increased, reaching a minimum at some jet-to-wire ratio which may be both hardware and speed dependent and increasing on either side of this point. To minimize MD/CD TEA, it is advisable to set the jet-to-wire ratio at a value which is close to the nadir of this curve.

As to forming consistency, lowering the forming consistency will generally cause better formation and hence an increase in both MD and CD tensile strength and thus increase the MD and CD TEA. To determine what forming consistency optimizes equality of the MD and CD TEA, the forming consistency can be altered and a graph of the MD/CD TEA versus forming consistency can be generated to select the optimal conditions.

Concerning creping variables, those variables that increase percent tensile reduction will generally tend to make MD/CD TEA ratio more equal. For example, greater web adhesion will cause greater MD tensile reduction during creping and, for equal stretch values, will decrease the MD TEA, thus making the MD/CD TEA ratio closer to one. Of course, this parameter would not apply to uncreped processes.

Reeling variables, such as percent stretch pull-out, can also be manipulated to make the MD and CD TEA values essentially equal. Again, since the MD TEA is generally larger than the CD TEA, more pull-out of the MD stretch via greater reel speed will tend to make the MD and CD TEA closer to equal. However, the pull-out should not be increased beyond the level that makes the TEAs approximately equal, lest the web be damaged. Since the optimum performance is obtained by having the TEAs essentially equal and a stretch of 5 percent or greater in both the MD and the CD, it is not desirable to reduce the MD stretch to less than 5 percent during winding of the web.

As an alternative to the above methods, the CD TEA can be increased by altering the process so as to place an elastomeric bonding material on the web. The bonding material may be, for instance, an ethylene vinyl acetate copolymer or other related polymers. Depending on the desired result, the bonding material may be applied only to, one side of the web or to both sides of the web. The elastomeric material can either be applied on the tissue machine, as described in U.S. Pat. No. 3,879,257 to Gentile et al., or in an off-line process as described in U.S. Pat. No. 6,423,180 to Behnke et al., both herein incorporated by reference. After application of the elastomeric material, the web may be creped if desired. The presence of the elastomeric material and the pattern utilized for the application of the elastomeric material can give increased CD stretch, increased CD TEA and, therefore, substantially equal MD and CD TEA.

It will be appreciated that the foregoing examples and discussion, given for purposes of illustration, are not to be construed as limiting the scope of this invention, which is defined by the following claims and all equivalents thereto.

We claim:

1. A tissue sheet having a three-dimensional surface topography, an MD/CD TEA ratio of from about 0.8 to about 1.2 and a CD stretch of about 5 percent or greater.

2. The tissue of claim 1 wherein the MD/CD TEA ratio is from about 0.9 to about 1.1.

3. The tissue sheet of claim 1 having a geometric mean tensile strength of from about 500 to about 1500 grams per 3 inches of width.

4. The tissue sheet of claim 1 having a geometric mean tensile strength of from about 550 to about 1200 grams per 3 inches of width.

5. The tissue sheet of claim 1 having a geometric mean tensile strength of from about 600 to about 1000 grams per 3 inches of width.

6. The tissue sheet of claim 1 having a geometric mean tensile strength of from about 600 to about 900 grams per 3 inches of width.

7. The tissue sheet of claim 1 having a GM TEA of from 2 to about 10 gram-centimeters per square centimeter.

8. The tissue sheet of claim 1 having a GM TEA of from about 2 to about 8 gram-centimeters per square centimeter.

9. The tissue sheet of claim 1 having a GM TEA of from about 2 to about 5 gram-centimeters per square centimeter.

10. The tissue sheet of claim 1 having a GM TEA of from about 2 to about 4 gram-centimeters per square centimeter.

11. The tissue sheet of claim 1 having an MD stretch of about 3 percent or greater.

12. The tissue sheet of claim 1 having an MD stretch of about 5 percent or greater.

13. The tissue sheet of claim 1 having an MD stretch of from about 3 to about 30 percent.

14. The tissue sheet of claim 1 having an MD stretch of from about 3 to about 25 percent.

15. The tissue sheet of claim 1 having an MD stretch of from about 3 to about 15 percent.

16. The tissue sheet of claim 1 having an MD stretch of from about 3 to about 10 percent.

17. The tissue sheet of claim 1 wherein the CD stretch is from about 5 to about 20 percent.

18. The tissue sheet of claim 1 wherein the CD stretch is from about 5 to about 15 percent.

19. The tissue sheet of claim 1 wherein the CD stretch is from about 5 to about 10 percent.

20. The tissue sheet of claim 1 having a CD stretch which is greater than the MD stretch.

21. A tissue sheet of claim 1 having a Normalized Burst Strength of from about 20 to about 40 centimeters.

22. The tissue sheet of claim 21 having a Normalized Burst Strength of from about 20 to about 35 centimeters.

23. The tissue sheet of claim 21 having a Normalized Burst Strength of from about 25 to about 35 centimeters.

24. The tissue sheet of claim 21 having a Normalized Burst Strength of from about 25 to about 30 centimeters.

25. A bath tissue sheet having a three-dimensional surface topography, an MD/CD TEA ratio of from about 0.8 to about 1.2, a Normalized Burst Strength of from about 20 to about 40 centimeters, a CD stretch of from about 5 to about 20 percent, an MD stretch of from about 3 to about 30 percent, a GMT of from about 500 to about 1500 grams per 3 inches of width and a GM TEA of from about 2 to about 10 gram-centimeters per square centimeter.

26. The bath tissue sheet of claim 25 having an MD/CD TEA ratio of from about 0.9 to about 1.1.

27. The bath tissue sheet of claim 25 having an MD/CD TEA ratio of about 1.0.

28. The bath tissue sheet of claim 25 having a Normalized Burst Strength of from about 20 to about 35 centimeters.

29. The bath tissue sheet of claim 25 having a Normalized Burst Strength of from about 25 to about 35 centimeters.

30. The bath tissue sheet of claim 25 having a Normalized Burst Strength of from about 250 to about 30 centimeters.

* * * * *